US006902631B2

(12) United States Patent
Lund et al.

(10) Patent No.: US 6,902,631 B2
(45) Date of Patent: Jun. 7, 2005

(54) AIR-HARDENING, LOW TO MEDIUM CARBON STEEL FOR IMPROVED HEAT TREATMENT

(75) Inventors: Thore Lund, Göteborg (SE); Patrik Ölund, Hofors (SE); Staffan Larsson, Köping (SE); Peter Neuman, Nieuwegein (NL); Oliver Rösch, Niederwerrn (DE)

(73) Assignee: Ovako Steel AB, Hofors (SE)

( * ) Notice: Subject to any disclaimer, the term of this patent is extended or adjusted under 35 U.S.C. 154(b) by 0 days.

(21) Appl. No.: 10/120,361

(22) Filed: Apr. 12, 2002

(65) Prior Publication Data

US 2002/0155018 A1 Oct. 24, 2002

Related U.S. Application Data

(62) Division of application No. 09/703,662, filed on Nov. 2, 2000, now abandoned.

(30) Foreign Application Priority Data

Nov. 2, 1999 (SE) ..... 9903968

(51) Int. Cl.[7] ..... C23C 8/80; C23C 8/22; C21D 1/18

(52) U.S. Cl. ..... 148/226; 148/663

(58) Field of Search ..... 148/226, 660, 148/663; 420/105

(56) References Cited

U.S. PATENT DOCUMENTS

| | | | |
|---|---|---|---|
| 3,615,879 | A | 10/1971 | Herzog et al. |
| 3,615,905 | A | 10/1971 | Omsen et al. |
| 3,713,905 | A | 1/1973 | Philip et al. |
| 3,901,690 | A | 8/1975 | Philip et al. |
| 3,944,442 | A | 3/1976 | Donachie |
| 4,957,702 | A | 9/1990 | Fang et al. |
| 5,094,923 | A | 3/1992 | Materkowski |
| 5,370,751 | A | 12/1994 | von Hagen et al. |

FOREIGN PATENT DOCUMENTS

| | | | |
|---|---|---|---|
| JP | 53-130218 | A | 11/1978 |
| JP | 79-001645 | B | 1/1979 |
| JP | 62-027551 | A | 2/1987 |
| JP | 06-017187 | A | 1/1994 |
| WO | 97-49838 | A1 | 12/1997 |

OTHER PUBLICATIONS

Smith, William, "Principles of Materials Science And Engineering", 1986, McGraw–Hill, Inc., pp. 459–462.*

* cited by examiner

*Primary Examiner*—Roy King
*Assistant Examiner*—Harry D. Wilkins, III
(74) *Attorney, Agent, or Firm*—Burns, Doane, Swecker & Mathis, L.L.P

(57) ABSTRACT

A steel to be air-hardened as part of heat treatments such as hardening-and-tempering, induction hardening, carburizing, carbonitriding or nitriding comprising, in weight %:

| | |
|---|---|
| C | 0.10–0.55; |
| Si | 0.97–2.03; |
| Mn | 1.14–1.83; |
| Cr | 0.00–1.65; |
| Mo | 0.36–0.58; and |

the balance Fe + impurities.

22 Claims, 3 Drawing Sheets

AIR-HARDENING, LOW TO MEDIUM CARBON STEEL FOR IMPROVED HEAT TREATMENT

This application is a divisional of Application Ser. No. 09/703,662, filed on Nov. 2, 2000 now abandoned.

1. Field of the Invention

The invention relates to a low to medium carbon air-hardening steel suitable for use in heat treatment processes such as carburizing, harden-and-tempering, carbonitriding, nitrocarburization, nitriding and/or induction hardening in steel component production.

2. Background

Many components intended for demanding applications are produced by the same manufacturing route. Initially, tubes, bars or rings are produced by hot rolling or hot forging. These processes are then followed either by a soft forming to the final shape of the components followed by a surface property modifying process such as carburizing or a harden-and-tempering operation. In some cases the material is hardened and tempered and the final component shaping is performed in the hardening stage.

The surface property modifying processes, such as carburizing, are complex, expensive and time consuming. It is known that an increased base material carbon content significantly can reduce the carburizing times. A hardening operation is executed in order to achieve components with good strength, high wear resistance, good thermal stability in operation and high fatigue resistance.

The hardening operation is conventionally performed by quenching the initial shapes or the final components in a fluid medium (most often oil or salt baths) with high cooling power in order to attain the desired hardness and properties. The high quenching rate gives large problems with distortion, which must be rectified. This significantly adds to the component production costs.

The quenching media used are environmentally harmful, require extensive maintenance to operate properly, are health hazards, generate fire risks and are costly. Attempts to replace this, such as standard quenching process with high-pressure gas cooling have only been successful to a minor extent due to the large difference in quenching power of gases compared to oil or salt baths.

SUMMARY OF THE INVENTION

An object of this invention is to overcome the above-mentioned disadvantages, and others, by providing low to medium carbon steels that can be air hardened and tempered to obtain desired properties in a more cost effective way, and also gives opportunities to reduce the time required for surface modifying processes such as carburizing. The invention also gives several other benefits with regard to environmental issues and hardening distortion.

These and other objects are achieved with a steel according to the invention, which comprises, consists essentially of, or consists of, in weight %:

| | |
|---|---|
| C | 0.10–0.55; |
| Si | 0.97–2.03; |
| Mn | 1.14–1.83; |
| Cr | 0.00–1.65; |
| Mo | 0.36–0.58; and |
| the balance Fe + impurities. | |

Steels with such compositions can also be used as a structural steel with enhanced properties and similar cost in comparison to micro-alloyed and similar steels today used for structural members.

DETAILED DESCRIPTION OF THE INVENTION

The invention is described by comparing normal processing routes and product properties to the processing routes and properties, for steels according to the present invention, attained for different application examples.

Case Hardening

Today, a steel with a carbon content of about 0.2% (typically SAE 8620) is selected and after manufacturing of the raw material (as bars, forgings or tubes) by hot forming, final components are then made by soft forming. These components are then carburized in order to give a surface zone, which has about 0.8% carbon. After carburizing, the components are hardened by heating to the austenitisation temperature and then quenched in an oil or salt bath.

With the invention, the component is carburised as in the above example, but the time for carburizing can be reduced by selecting a steel with an increased base material carbon content. This will significantly reduce the required carburizing time.

Regardless of the carbon content, steel according to the invention can be hardened directly from the carburization temperature by a slow cooling in air or, if so desired, with assistance of forced air or cooling gases.

Figure 1:
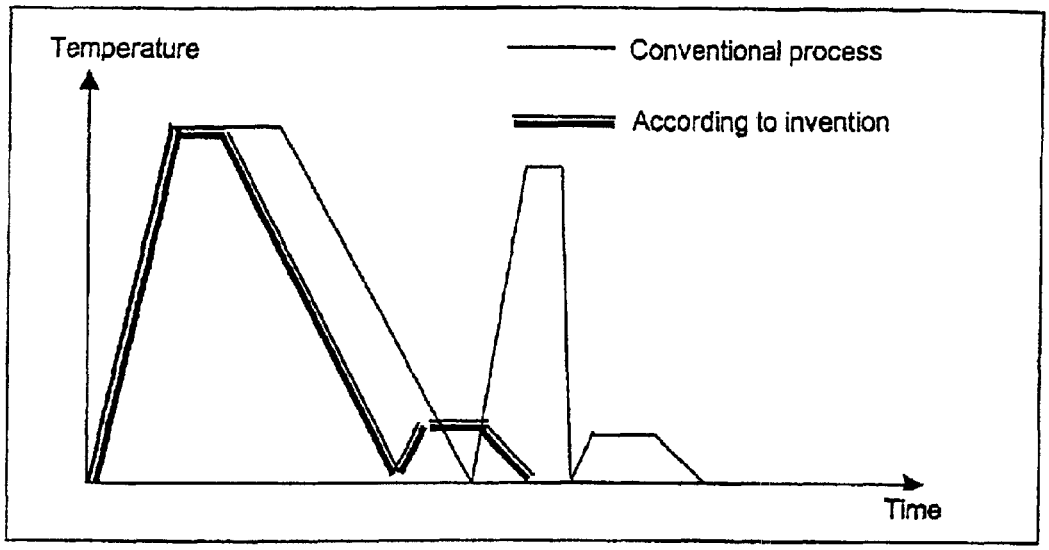
FIG. 1 is a Time-Temperature diagram comparing a conventional treatment cycle with a treatment cycle for a steel according to the present invention.
Figure 2:
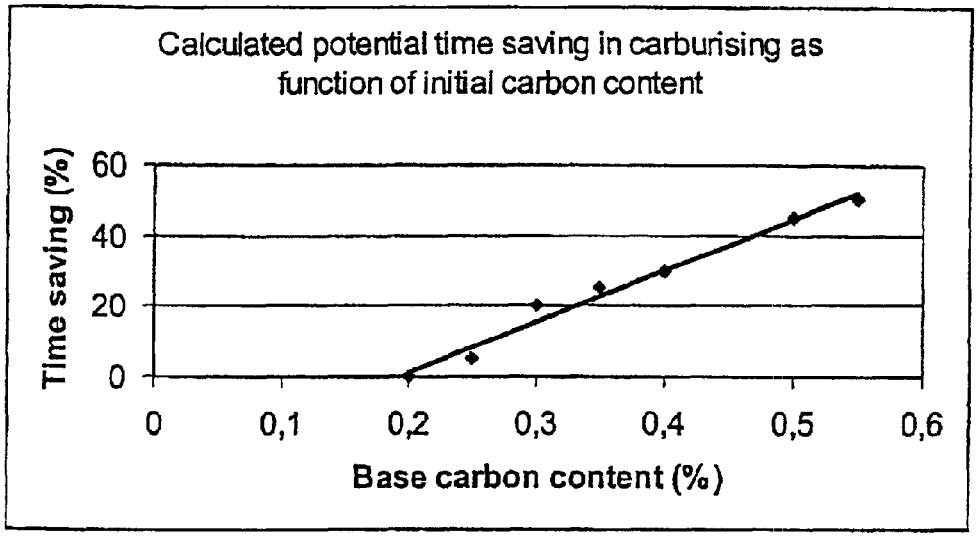
FIG. 2 is a plot of time savings vs. carbon content for the carburization of a steel according to the present invention.

FIG. 1 compares a typical execution of the conventional processing route to a processing route for a steel according to the invention. FIG. 2 shows the time reduction which can be attained in the carburization step with a steel according to the invention, depending on the base material carbon content selected.

Hardening-and-tempering

Hardening-and-tempering is conventionally performed either on the component pre-material (as forgings, bars or tubes) or on the soft machined final components. The hardening-and-tempering operation typically comprises heating to the austenitizing temperature, quenching in an oil or salt bath and then tempering at a temperature adjusted to give the desired component properties.

With the invention, hardening and tempering can be achieved by directly air-hardening the steel from the hot forming (forging or rolling) temperature. In the case of machined components, this is achieved by air-hardening after the austenitizing operation. In both cases, air hardening is followed by tempering at the temperature needed to achieve the desired properties.

In the case where the air-hardening is performed from the forming (forging or rolling) temperature, the expensive and time consuming austenitization process can be completely avoided. The air-hardening has the cost, environment and health advantages mentioned earlier and, additionally, the distortion problems associated with the conventional quenching process can be avoided.

In the case where machined components are hardened and tempered, the advantages again are cost, environment, health and significantly reduced distortion problems.

Figure 3:
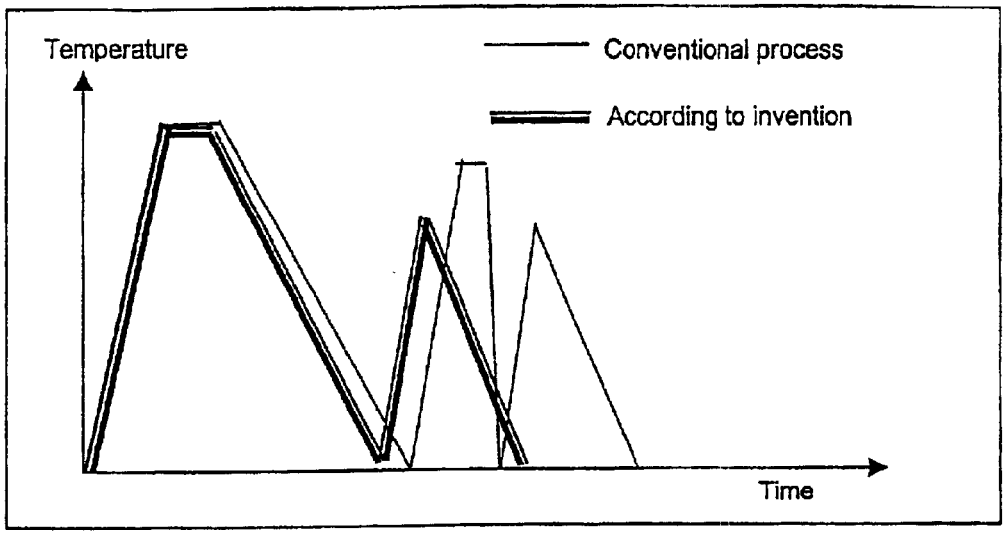
FIG. 3 is a Time-Temperature diagram comparing a conventional treatment cycle for hardening and tempering of unfinished components with such a cycle for a steel according to the present invention.

FIG. 3 shows the processing route for conventional hardening and tempering for component pre-forms as forgings, bars or tubes, and the corresponding route for a steel according to the invention.

The principles of the invention will now be further described by reference to the following illustrative example.

EXAMPLE

A steel with the composition according to the invention as given below has been evaluated.

| C | Si | Mn | Cr | Mo | Fe and impurities |
|---|---|---|---|---|---|
| 0.39 | 1.73 | 1.42 | 1.53 | 0.44 | remainder |

Figure 4:
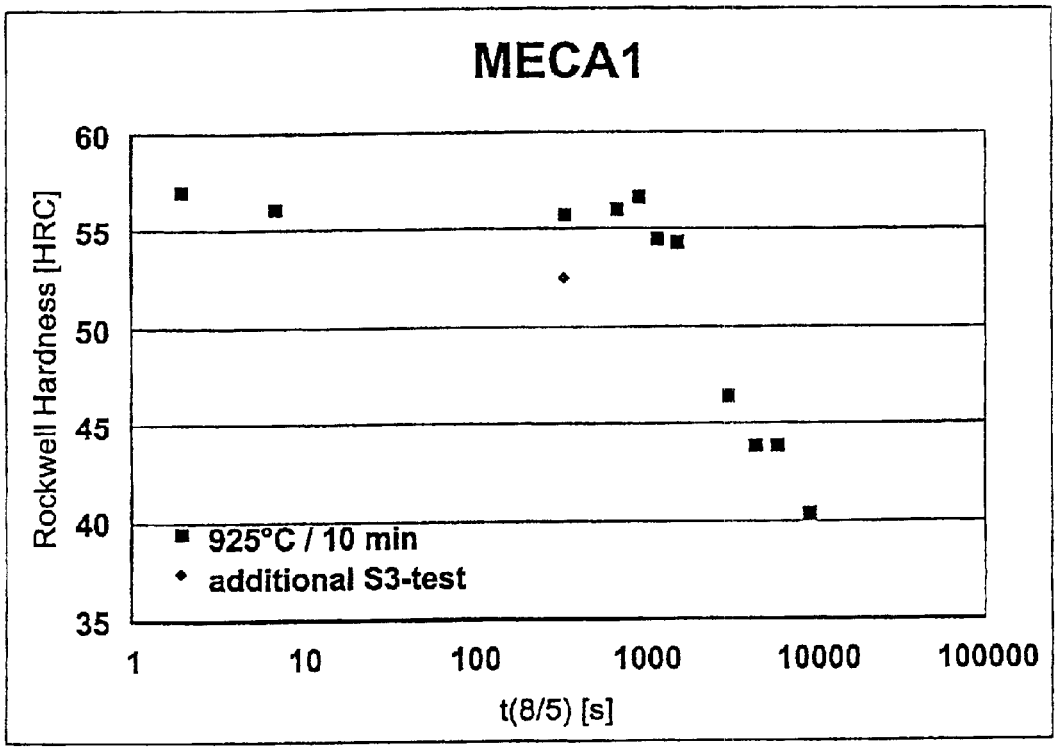
FIG. 4 is a plot of hardness vs. cooling rate for a steel according to the present invention.

By Dilatometer evaluations and practical tests, the relationship between cooling rate in the temperature range between 800 and 500 degrees centigrade (t800/500) and resulting hardness has been determined, and is illustrated in FIG. 4. The evaluation shows that solid bars with diameters up to 60 mm will through harden to full martensitic hardness when cooled in still air.

Figure 5:
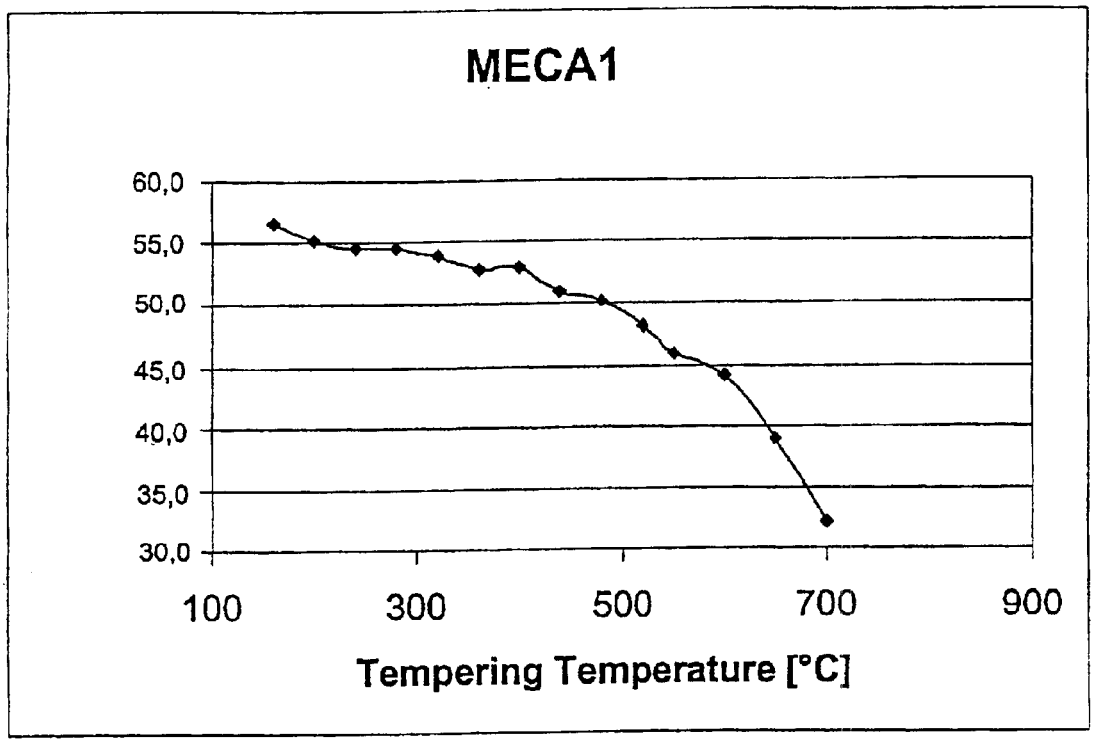
FIG. 5 is a plot of hardness vs. tempering temperature for a steel according to the present invention.

The room temperature impact strength has been determined for such air-hardened samples (air-hardened by still air cooling from a forging temperature of 1100° C.) as a function of the hardness attained when tempering at different temperatures, and is illustrated in FIG. 5.

This example shows that air-hardening can combine high strength with significant toughness.

It will be appreciated by those of ordinary skill in the art that the present invention can be embodied in other specific forms without departing from the spirit or essential characteristics thereof. The presently disclosed embodiments are therefore considered in all respects to be illustrative, and not restrictive. The scope of the invention is indicated by the appended claims, rather than the foregoing description, and all changes that come within the meaning and range of equivalents thereof are intended to be embraced therein.

What is claimed is:

1. A method of hardening and tempering a steel component, the method comprising:

(i) selecting a composition of the steel component consisting of: C 0.10–0.55; Si 0.97–2.03; Mn 1.14–1.83; Cr 0.00–1.65; Mo 0.36–0.58; and the balance Fe+ impurities;

(ii) hot forming the steel component;

(iii) soft forming the steel component thereby providing the component with a final shape; and (iv) heat treating the steel component with a heat treatment, wherein the heat treatment includes hardening the steel component by heating the steel component to a carburization temperature, holding the steel component at the carburization temperature for a period of time and cooling the steel component directly from the carburization temperature in at least one of: air; forced air; and cooling gases at a rate sufficiently high to form martensite in the steel component, and directly tempering the hardened steel component.

2. The method of claim 1, wherein step (i) comprises selecting a steel component having a composition consisting of: C 0.10–0.30; Si 0.97–2.03; Mn 1.14–1.83; Cr0.00–1.65; Mo 0.36–0.58; and the balance Fe+ impurities.

3. The method of claim 2, wherein the sufficiently high rate is from 100° C. per second to 0.03° C. per second.

4. The method of claim 1, wherein the rate is no faster than 100° C. per second.

5. The method of claim 4, wherein the rate is no slower than 0.3° C. per second.

6. The method of claim 4, wherein the rate is from 100° C. per second to 0.03° C. per second.

7. The method of claim 6, wherein the rate is maintained during cooling from 800° C. to 500° C.

8. A method of hardening and tempering a steel component, the method comprising:

(i) selecting a composition of the steel component consisting of: C 0.10–0.55; Si 0.97–2.03; Mn 1.14–1.83; Cr 0.00–1.65; Mo 0.36–0.58; and the balance Fe+ impurities;

(ii) hot forming the steel component at a hot forming temperature;

(iii) heat treating the steel component with a heat treatment, wherein the heat treatment includes hardening the steel component by cooling the steel component directly from the hot forming temperature in at least one of: air; forced air; and cooling gases at a rate sufficiently high to form martensite in the steel component, and directly tempering the hardened steel component.

9. The method of claim 8, wherein step (i) comprises selecting a steel component having a composition consisting of: C 0.10–0.30; Si 0.97–2.03; Mn 1.14–1.83; Cr 0.00–1.65; Mo 0.36–0.58; the balance Fe+ impurities.

10. The method of claim 9, wherein the sufficiently high rate is from 100° C. per second to 0.03° C. per second.

11. The method of claim 8, wherein the rate is no faster than 100° C. per second.

12. The method of claim 11, wherein the rate is no slower than 0.3° C. per second.

13. The method of claim 11, wherein the rate is from 100° C. per second to 0.03° C. per second.

14. The method of claim 13, wherein the rate is maintained during ccoling from 800° C. to 500° C.

15. A method of hardening and tempering a steel component, the method comprising:

(i) selecting a composition of the steel component consisting of: C 0.10–0.55; Si 0.97–2.03; Mn 1.14–1.83; Cr 0.00–1.65; Mo 0.36–0.58; and the balance Fe+ impurities;

(ii) hot forming the steel component;

(iii) soft forming the steel component thereby providing the component with a final shape; and (iv) heat treating the steel component with a heat treatment, wherein the heat treatment consists of:

hardening the steel component by heating the steel component to the carburization temperature, holding the steel component at the carburization temperature for the period of time, and cooling the steel component directly from the carburization temperature in at least one of: air; forced air; and cooling gases at the a sufficiently high rate; and tempering the hardened steel component at a tempering temperature.

16. The method of claim 15, wherein the sufficiently high rate is from 100° C. per second to 0.03° C. per second.

17. The method of claim 16, wherein the sufficiently high rate is maintained during cooling from 800° C. to 500° C.

18. The method of claim 15, wherein step (i) comprises selecting a steel component having a composition consisting of: C 0.10–0.30; Si 0.97–2.03; Mn 1.14–1.83; Cr0.00–1.65; Mo 0.36–0.58; and the balance Fe+ impurities.

19. A method of hardening and tempering a steel component, the method comprising:

(i) selecting a composition of the steel component consisting of: C 0.10–0.55; Si 0.97–2.03; Mn 1.14–1.83; Cr 0.00–1.65; Mo 0.36–0.58; and the balance Fe+ impurities;

(ii) hot forming the steel component at a hot forming temperature;

(iii) heat treating the steel component with a heat treatment, wherein the heat treatment consists of:

hardening the steel component by cooling the steel component directly from the hot forming temperature in at least one of: air; forced air, and cooling gases at a sufficiently high rate; and tempering the hardened steel component at a tempering temperature.

20. The method of claim 19, wherein the sufficiently high rate is from 100° C. per second to 0.03° C. per second.

21. The method of claim 20, wherein the sufficiently high rate is maintained during cooling from 800° C. to 500° C.

22. The method of claim 19, wherein step (i) comprises selecting a steel component having a composition consisting of: C 0.10–0.30; Si 0.97–2.03; Mn 1.14–1.83; Cr0.00–1.65; Mo 0.36–0.58; and the balance Fe+ impurities.

* * * * *